US011642711B2

(12) United States Patent
Takemoto et al.

(10) Patent No.: US 11,642,711 B2
(45) Date of Patent: May 9, 2023

(54) DRAWING MACHINE AND DRAWING METHOD

(71) Applicant: FAE Inc., Osaka (JP)

(72) Inventors: Kosuke Takemoto, Osaka (JP); Kenichi Tashima, Osaka (JP)

(73) Assignee: FAE Inc., Osaka (JP)

( * ) Notice: Subject to any disclaimer, the term of this patent is extended or adjusted under 35 U.S.C. 154(b) by 466 days.

(21) Appl. No.: 16/466,615

(22) PCT Filed: Dec. 6, 2016

(86) PCT No.: PCT/JP2016/086275
§ 371 (c)(1),
(2) Date: Jun. 4, 2019

(87) PCT Pub. No.: WO2018/105042
PCT Pub. Date: Jun. 14, 2018

(65) Prior Publication Data
US 2020/0061688 A1 Feb. 27, 2020

(51) Int. Cl.
*B21C 1/08* (2006.01)
*B21C 1/12* (2006.01)
(Continued)

(52) U.S. Cl.
CPC ..... *B21C 1/08* (2013.01); *B21C 1/12* (2013.01); *B21B 2015/0028* (2013.01);
(Continued)

(58) Field of Classification Search
CPC .... B21C 1/04; B21C 1/08; B21C 1/12; B21C 1/14; B21C 1/22; B21B 37/48; B21B 37/50
(Continued)

(56) References Cited

U.S. PATENT DOCUMENTS 2,926,292 A * 2/1960 Hart ..... B21C 1/12 318/7
3,765,215 A * 10/1973 Martin ..... B21C 1/24 72/289
(Continued)

FOREIGN PATENT DOCUMENTS

FR 2336190 7/1977
JP 2001-179326 7/2001
(Continued)

*Primary Examiner* — Shelley M Self
*Assistant Examiner* — Smith Oberto Bapthelus
(74) *Attorney, Agent, or Firm* — Levine Bagade Han LLP

(57) ABSTRACT

A drawing machine comprising: a first drawing unit that includes a first drawing die, a first upstream capstan that is provided before the first drawing die so as to deliver the metal tube to the first drawing die, and a first downstream capstan that is provided after the first drawing die so as to draw the metal tube from the first drawing die; a second drawing unit that includes a second drawing die that draws the metal tube delivered from the first drawing unit, a second upstream capstan that is provided before the second drawing die so as to deliver the metal tube to the second drawing die, and a second downstream capstan that is provided after the second drawing die so as to draw the metal tube from the second drawing die; and a tension applying section that applies a predetermined tension to the metal tube between the first drawing unit and the second drawing unit.

20 Claims, 2 Drawing Sheets

(51) Int. Cl.

| | |
|---|---|
| ***B21B 15/00*** | (2006.01) |
| ***B21C 1/14*** | (2006.01) |
| ***B21C 1/22*** | (2006.01) |
| ***B21C 37/06*** | (2006.01) |

(52) U.S. Cl.
CPC ..... *B21C 1/14* (2013.01); *B21C 1/22* (2013.01); *B21C 37/06* (2013.01)

(58) Field of Classification Search
USPC ..... 72/8.6, 11.4, 12.3
See application file for complete search history.

(56) References Cited

U.S. PATENT DOCUMENTS

| | | | | |
|---|---|---|---|---|
| 4,615,195 | A * | 10/1986 | Vogel | B21C 1/04 72/128 |
| 2015/0183013 | A1* | 7/2015 | Takemoto | B21C 1/08 72/279 |

FOREIGN PATENT DOCUMENTS

| | | | |
|---|---|---|---|
| JP | 2003-053418 | A | 2/2003 |
| JP | 2005-103623 | | 4/2005 |
| JP | 5100129 | | 12/2012 |
| JP | 2015-128775 | | 7/2015 |

* cited by examiner

DRAWING MACHINE AND DRAWING METHOD

CROSS-REFERENCE TO RELATED APPLICATIONS

This application is a U.S. national stage application filed under 35 U.S.C. 371 of International Patent Application No. PCT/JP2016/086275 filed Dec. 6, 2016, the content of which is incorporated herein by reference in its entirety for all purposes.

TECHNICAL FIELD

The present invention relates to a drawing machine and a drawing method for drawing a metal tube.

BACKGROUND ART

One example of a conventional wire drawing machine is described in JP2003-053418 A (Patent Document 1), and is referred to as a slip-type wire drawing machine. Such conventional slip-type wire drawing machine sets the rotation speed of a capstan higher than the speed of the metal wire so as to cause a slip between the capstan and the metal wire and, using the capstan, the metal wire is pulled through a wire drawing die, thereby drawing the metal wire.

CITATION LIST

Patent Document

Patent Document 1: JP2003-053418 A

SUMMARY

Technical Problem

However, in a situation where the above-mentioned conventional wire drawing machine draws a pipe-shaped metal tube having a hollow structure such as a narrow tube, it is not capable of controlling the outer diameter and the inner diameter of the metal tube.

Solution to Problem

In order to solve the problem above, an aspect of the present invention provides a drawing machine including: a first drawing unit that includes a first drawing die that reduces at least an outer diameter of a metal tube passing therethrough, thereby drawing the metal tube, a first upstream capstan that is provided before the first drawing die so as to deliver the metal tube to the first drawing die, and a first downstream capstan that is provided after the first drawing die so as to draw the metal tube from the first drawing die; a second drawing unit that includes: a second drawing die that reduces at least the outer diameter of the metal tube delivered from the first drawing unit, thereby drawing the metal tube, a second upstream capstan that is provided before the second drawing die so as to deliver the metal tube to the second drawing die, and a second downstream capstan that is provided after the second drawing die so as to draw the metal tube from the second drawing die; and a tension applying section that applies a predetermined tension to the metal tube between the first drawing unit and the second drawing unit.

DESCRIPTION OF EMBODIMENTS

The invention will now be described by means of its embodiment with reference to the attached drawings. However, the following embodiment is not intended to limit the invention set forth in the claims and all the combinations of features described in the embodiment are not necessarily indispensable for the solution according to the invention.

In the present embodiment, a metal tube 10 has a pipe-shaped structure. In other words, the metal tube 10 has, in a cross-section perpendicular to the extending direction of the metal tube, a predetermined outer diameter (hereinafter also referred to as the "outer diameter of the metal tube 10") and, on the inner side thereof (e.g., at the center of the cross-section), a circular or elliptical space having a predetermined inner diameter (hereinafter also referred to as the "inner diameter of the metal tube 10"). It should be noted that a drawing machine 1 according to the present embodiment may be a drawing machine that draws, in addition to the metal tube 10 having the pipe-shaped structure, a metal wire made of materials having different physical properties (e.g., hardness) at an inner side and an outer side in a cross-section perpendicular to the extending direction of the metal tube.

Configuration of Drawing Machine 100

Figure 1:
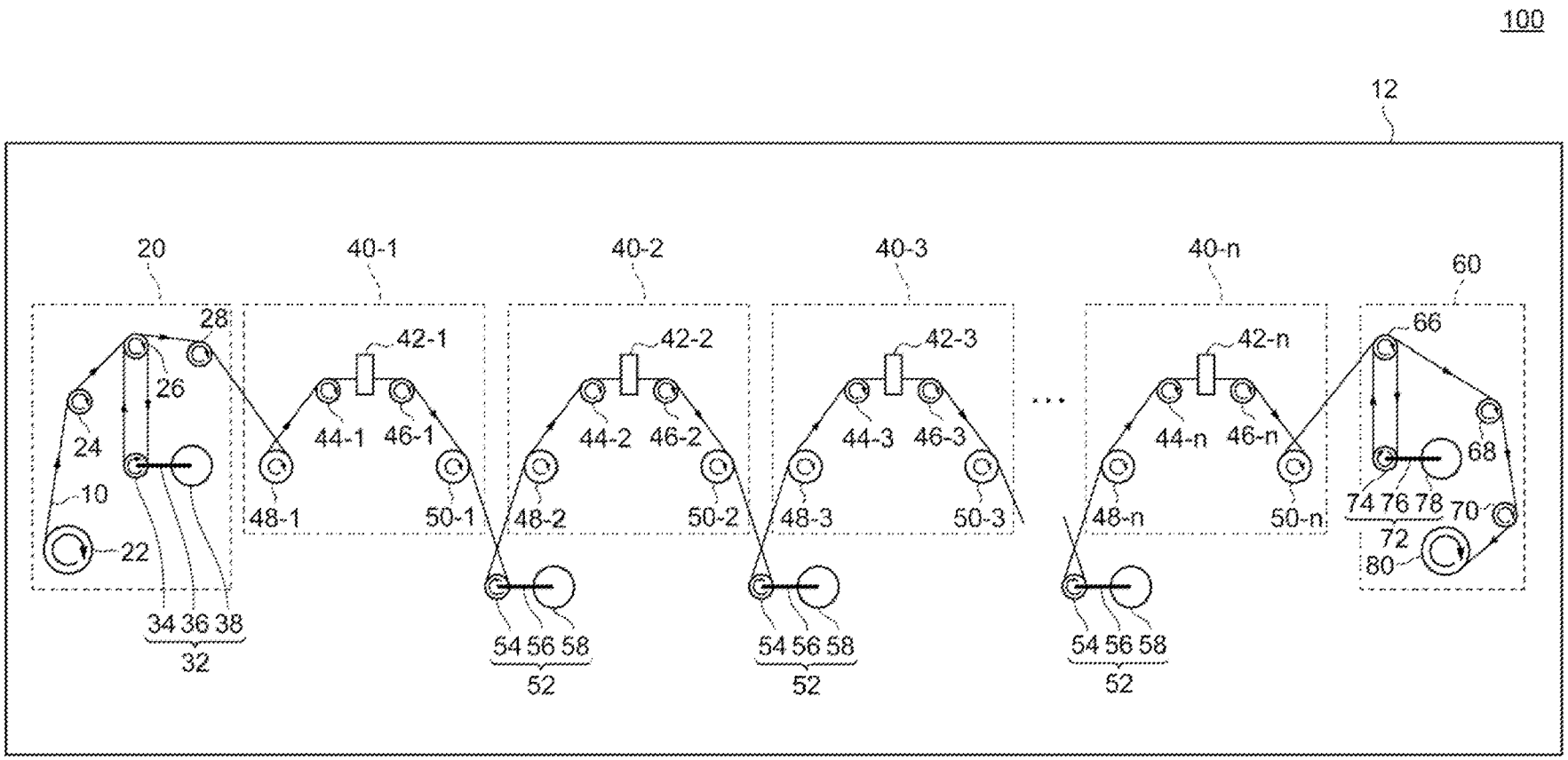
FIG. 1 is a schematic view showing a configuration of a drawing machine 100 according to an embodiment of the invention.
Figure 2:
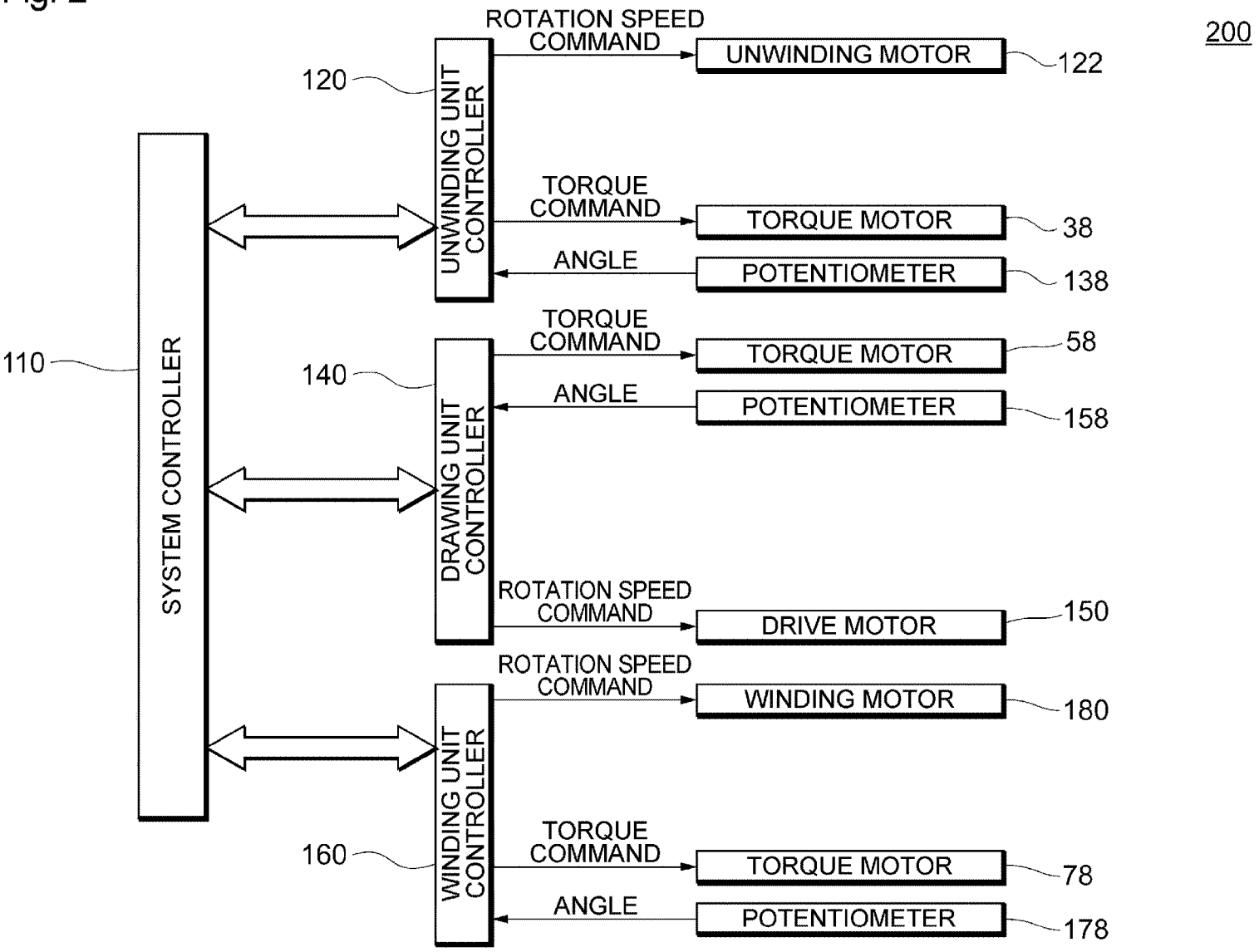
FIG. 2 is a block diagram illustrating a configuration of a control unit 200 that controls the drawing machine 100.

FIG. 1 is a schematic view showing a configuration of a drawing machine 100 according to an embodiment of the invention. FIG. 2 is a block diagram illustrating a configuration of a control unit 200 that controls the drawing machine 100 in the above embodiment.

In the present embodiment, the drawing machine 100 is configured so as to include a housing 12, an unwinding unit 20, drawing units 40, a winding unit 60 and a control unit 200 that controls each unit. In the drawing machine 100, the unwinding unit 20, the drawing unit 40 and the winding unit 60 are arranged in this order along the route through which a metal tube 10 is delivered out, drawn and wound (hereinafter referred to as the "passage"), from upstream to downstream (from left to right in FIG. 1). The drawing machine 100 draws the metal tube delivered from the unwinding unit 20 sequentially at the respective drawing units 40 by reducing the diameter thereof, and winds up the metal tube 10 with the reduced diameter at the winding unit 60.

The control unit 200 controls the operation of the drawing machine 100. The control unit 200 is configured so as to have a system controller 110, an unwinding unit controller 120, a drawing unit controller 140 and a winding unit controller 160. The system controller 110 is connected to the unwinding unit controller 120, the drawing unit controller 140 and the winding unit controller 160, and performs overall control of each unit controller.

The unwinding unit controller 120, the drawing unit controller 140 and the winding unit controller 160 are connected to various components provided in the unwinding unit 20, the drawing units 40 and dancer sections 52, and the winding unit 60, respectively, and control the respective units. Although only one drawing unit controller 140 is shown in FIG. 2, a drawing unit controller 140 is provided for each of the n stages of drawing units 40-1 to **40-*n*** (n being a positive integer).

The system controller 110, and the unwinding unit controller 120, the drawing unit controller 140 and the winding unit controller 160 provided in the control unit 200 control the unwinding unit 20, the drawing unit 40 and the dancer section 52, and the winding unit 60 as stated above, so as to deliver the metal tube 10 from the unwinding unit 20, draw it by causing it to pass through the respective drawing units 40-1 to **40-*n*, and wind it up at the winding unit 60**.

Each structure in the drawing machine 100 will be described below, referring to FIGS. 1 and 2. In the present embodiment, as illustrated in FIG. 1, n stages of drawing units 40 are serially arranged between the unwinding unit 20 and the winding unit 60 along the route through which the metal tube 10 is delivered, so as to sequentially draw the metal tube 10. In the below description, the drawing units 40 are respectively referred to as drawing units 40-1 to **40-*n* along the direction extending from the unwinding unit 20 toward the winding unit 60. The drawing machine 100 also has n−1 stages of dancer sections 52 and each dancer section 52 is provided between the adjacent drawing units 40**.

Unwinding Unit 20

The unwinding unit 20 is configured so as to have an unwinding bobbin 22, guide rollers 24, 26 and 28, and a dancer section 32. In the unwinding unit 20, the metal tube 10 is provided so as to run across the unwinding bobbin 22, the guide roller 24, the guide roller 26, a dancer roller 34, the guide roller 26 and the guide roller 28, in this order, with a predetermined tension being applied thereto (hereinafter, the metal tube provided in such manner will be described as being "provided in a tensioned state").

The unwinding bobbin 22 is rotatably mounted in the housing 12 of the drawing machine 100. The unwinding bobbin 22 is connected to an unwinding motor 122 and rotates when driven by the motor. With that rotation, the metal tube 10 wound around the unwinding bobbin 22 is pulled out therefrom and delivered to the passage. In the present embodiment, the unwinding bobbin 22 is driven by the unwinding motor 122 at a controlled speed. That is, the unwinding unit controller 120 controls the drive of the unwinding motor 122 so that the unwinding bobbin 22 rotates at a predetermined speed. The unwinding unit controller 120 controls the rotation speed of the unwinding motor 122 based on the angle of a dancer arm 36 detected by a potentiometer 138.

The guide rollers 24, 26 and 28 are rotatably mounted in the housing 12 of the drawing machine 100. The metal tube 10 is wound around each of the guide rollers 24, 26 and 28 a predetermined number of times so as to allow the metal tube 10 to be delivered in a non-slip manner. The guide rollers 24, 26 and 28 rotate due to tension applied to the metal tube 10 by the drawing unit 40, so that the metal tube 10 delivered from the unwinding bobbin 22 is sequentially delivered in a non-slip manner along the passage.

The dancer section 32 is configured so as to include the dancer roller 34, a dancer arm 36 and a torque motor 38, and applies a desired tension to the metal tube 10 delivered from the unwinding bobbin 22.

The dancer roller 34 is rotatably supported at one end of the rod-shaped dancer arm 36. The metal tube 10 is provided in a tensioned state across the guide roller 24, the guide roller 26, the dancer roller 34, the guide roller 26 and the guide roller 28, in this order, and a predetermined tension is applied to the metal tube 10 by the dancer roller 34 in a downward direction in FIG. 1.

The dancer arm 36 is arranged approximately horizontally in FIG. 1, i.e. in a direction approximately perpendicular to the direction in which tension is applied to the metal tube 10 by the dancer roller 34. This horizontal arrangement is regarded as a reference position for the dancer arm 36. The other end of the dancer arm 36 is supported so as to be fixed to a drive shaft of the torque motor 38 and the drive shaft of the torque motor 38 acts as the pivot point of the dancer arm 36.

The potentiometer 138 (FIG. 2) is provided at the drive shaft of the torque motor 38 and it detects a pivot angle of the dancer arm 36. The potentiometer 138 is connected to the unwinding unit controller 120 and provides the pivot angle detected by the potentiometer 138 to the drawing unit controller 140. It should be noted here that, although the potentiometer 138 detects a pivot angle of the dancer arm 36 in the present embodiment, the potentiometer 138 may detect a position or displacement of the dancer roller 34, for example, a position or displacement of the dancer roller 34 in a direction in which tension is applied to the metal tube 10 by the dancer roller 34. In that case, tension may be applied to the metal tube 10 by vertically moving the dancer roller 34 (linearly moving it in a direction of applying tension to the metal tube), instead of rotating the dancer roller 34.

The torque motor 38 applies a predetermined tension to the metal tube 10 through the dancer arm 36 and the dancer roller 34. That is, the torque motor 38 transmits its rotation torque to the metal tube 10 through the dancer arm 36 and the dancer roller 34, thereby applying tension to the metal tube 10. The torque motor 38 is connected to the unwinding unit controller 120 and generates a predetermined rotation torque based on the commands (torque commands) from the unwinding unit controller 120.

The dancer section 32 may have, instead of the torque motor 38, an actuator such as a servomotor (which is used in, for example, a torque control mode), a rotary solenoid (which is used, for example, to generate a rotation torque according to a supplied current), an air cylinder (which is used, for example, to adjust the thrust of the dancer arm 36) and a DC motor (which is used to generate a rotation torque according to a supplied current). The dance section 32 may have, instead of an actuator such as the torque motor 38, a weight (for adding the weight of such weight to the dancer arm 36), a spring (a tension spring or compression spring connected to the dancer arm 36 and used to adjust the tension position or compression position thereof), a spiral spring (which is arranged about the rotation axis of the dancer arm 36 and wound for use), etc. Each of the means indicated above as examples is used for controlling the tension applied to the metal tube 10 so as to make such tension have a predetermined value.

Although the dancer section 32 applies a tension to the metal tube 10 via the pivoting dancer arm 36, the configuration is not limited thereto. The dancer section 32 may have a dancer roll that moves, for example, vertically or horizontally and may apply a tension to the metal tube 10 via such dancer roll. In such case, the position of the dancer roll may be detected by using, for example, a linear encoder, a position-proportional-output-type position sensor, an ultrasonic ranging sensor, a laser range finder, etc. to control the tension applied to the metal tube 10.

By transmitting the predetermined torque generated by the torque motor 38 to the metal tube 10 through the dancer arm 36 and the dancer roller 34 with the above configuration, the dancer section 32 applies a particular set tension to the metal tube 10. In other words, the tension applied to the metal tube 10 delivered from the unwinding unit 20 is determined according to the rotation torque of the torque motor 38.

As described above, in the unwinding unit 20 of the present embodiment, the dancer section 32 applies a predetermined tension to the metal tube 10 delivered from the unwinding bobbin 22 at a constant speed and this allows the metal tube 10 to be delivered to the drawing unit 40-1 with a desired tension being applied.

Drawing Unit 40

In the present embodiment, the drawing machine 100 is configured so as to have n stages of drawing units 40-1 to **40-*n* between the unwinding unit 20 and the winding unit 60. The unwinding unit 20, the drawing units 40-1 to 40-*n* and the winding unit 60 are provided so as to be connected to each other. The metal tube 10 delivered from the unwinding unit 20 sequentially passes through the drawing units 40-1, 40-2, . . . 40-*n* in this order and is thereby drawn. The metal tube 10 drawn by the drawing unit 40-*n* is then delivered to the winding unit 60. Since the drawing units 40-1 to 40-*n* each have the same configuration in the present embodiment, the drawing units 40-1 to 40-*n* will hereinafter be collectively referred to as a "drawing unit 40" unless the drawing units 40-1 to 40-*n* are individually specified. Further, each of the structures included in the drawing units 40-1 to 40-*n*** will also be referred to collectively.

The drawing unit 40 is configured so as to have a drawing die 42, guide rollers 44 and 46, and drive capstans 48 and 50. In the drawing unit 40, the metal tube 10 is provided in a tensioned state across the guide roller 44, the drawing die 42, the guide roller 46 and the drive capstan 50.

The drawing die 42 is disposed between the guide roller 44 and the guide roller 46. The drawing die 42 has a die hole extending along the direction in which the metal tube 10 is provided in a tensioned state. When the metal tube 10 passes and is drawn through the die hole, the outer diameter of the metal tube 10 is reduced and the metal tube 10 is accordingly drawn. Here, the reduction rate of the diameter (the reduction rate of the cross-section) of the metal tube 10 is determined according to the diameter of the die hole provided in the drawing die 42, and the metal tube 10 is drawn according to the reduction rate. In each stage of the drawing units 40-1 to **40-*n*, the die hole diameter of the drawing die 42 is selected as appropriate so that the metal tube 10 drawn at the drawing unit 40-*n***, as the last stage, will have a desired diameter.

In the present embodiment, the drawing units 40-1 to **40-*n* gradually reduce the diameter of the metal tube 10 that passes therethrough. Accordingly, the die hole formed in the drawing die 42-*n* has a smaller diameter than that of the die hole formed in the drawing die 42-1. Further, the die hole formed in the drawing die 42-2 has a smaller diameter than that of the die hole formed in the drawing die 42-1**.

In the present embodiment, the drawing die 42 is stored in a die holder fixed to the housing 12. The drawing machine 100 may have means for measuring a force of the drawing when the metal tube 10 is drawn through the drawing die 42. Such measuring means may be, for example, means for detecting a force with which the drawing die 42 presses the die holder, which thereby measures the drawing force, and may alternatively be means for detecting a distortion of the die holder fixed to the housing 12, which thereby measures the drawing force.

Here, if the metal tube 10 and/or the drawing die 42 are immersed with lubricating oil, vibration, etc., of the metal tube 10 passing through the drawing die 42 can be prevented, thereby resulting in improved stability. Accordingly, an oil tank for immersing the metal tube 10 and/or the drawing die 42 with lubricating oil may be provided. For example, an oil tank may be arranged between the drawing die 42 and the guide roller 44 and the metal tube 10 may be configured so as to pass through the oil tank. In that case, it is preferable to provide means for supplying lubricating oil to the oil tank such that the lubricating oil flows over the oil tank during the drawing operation. Alternatively, an oil tank may be arranged so as to contain the drawing die 42 therein, and the metal tube 10 may be configured so as to pass through the oil tank in a vertical or horizontal manner. It should be noted, however, that a seal is needed at the portion through which the metal tube extends.

Immersing the metal tube 10 and/or the drawing die 42 with lubricating oil provides the following advantages. An optimum lubricating oil can be used for the drawing performed at the drawing die 42 in each drawing unit 40. The composition of the lubricating oil greatly affects the wearing of the drawing die 42, and the above configuration enables stable supply of a lubricating oil having a composition specialized for drawing. Furthermore, it is possible to simplify a circulation and cleaning system for the lubricating oil, which would be necessary to reduce the effects of contamination in the oil caused by abrasion between the metal tube 10 and the drive capstan 50, and this leads to reduced manufacturing costs.

The guide rollers 44 and 46 are rotatably mounted in the housing 12 of the drawing machine 100. The guide rollers 44 and 46 rotate due to tension applied to the metal tube 10 by the rotation of the drive capstan 48 or 50 and sequentially deliver the metal tube 10 along the passage in a non-slip manner.

The drive capstans 48 and 50 (which is an example of an upstream capstan and a downstream capstan) are rotatably mounted in the housing 12 of the drawing machine 100. A drive motor 150 (see FIG. 2) is connected to the drive capstans 48 and 50 and the drive capstans 48 and 50 rotate at a predetermined torque based on the commands from the drawing unit controller 140. The drive capstans 48 and 50 respectively deliver the metal tube 10 to the drawing die 42 and draw the metal tube 10 from the drawing die 42.

The outer surfaces of the drive capstans 48 and 50 are thermal-sprayed so as to increase the hardness of the surface and enhance durability and also to prevent a slip from occurring between the surfaces (surfaces in contact with the metal tube 10) of the drive capstans 48 and 50 and the metal tube 10. The outer surface of the drive capstan 50 may alternatively be coated with an elastic body having a large coefficient of friction (e.g., resins such as urethane and rubber). Such surface-treated drive capstan 50 allows the metal tube 10 to be drawn through the drawing die 42 in a non-slip manner and to be delivered to the next stage.

Dancer Section 52

The dancer section 52 is configured so as to include a dancer roller 54, a dancer arm 56 and a torque motor 58, and applies a tension to the drawn metal tube 10 in the drawing unit 40.

The dancer roller 54 is rotatably supported at one end of the rod-shaped dancer arm 56. The metal tube 10 is wound around the dancer roller 54 in a non-slip manner, and a tension is applied to the metal tube 10 by the dancer roller 54 in a downward direction in FIG. 1.

The dancer arm 56 is arranged approximately horizontally in FIG. 1, i.e., in a direction approximately perpendicular to the direction in which tension is applied to the metal tube 10 by the dancer roller 54. This horizontal arrangement is regarded as a reference position for the dancer arm 56. The other end of the dancer arm 56 is supported so as to be fixed to a drive shaft of the torque motor 58 and the drive shaft of the torque motor 58 acts as the pivot point of the dancer arm 56.

A potentiometer 158 (FIG. 2) is provided at the drive shaft of the torque motor 58 and it detects a pivot angle of the dancer arm 56. The potentiometer 158 is connected to the drawing unit controller 140 and provides the pivot angle detected by the potentiometer 158 to the drawing unit controller 140.

The torque motor 58 applies a predetermined tension to the metal tube 10 through the dancer arm 56 and the dancer roller 54. That is, the torque motor 58 transmits its rotation torque to the metal tube 10 through the dancer arm 56 and the dancer roller 54, thereby applying tension to the metal tube 10. The torque motor 58 is connected to the drawing unit controller 140 and generates a predetermined rotation torque based on the commands (torque commands) from the drawing unit controller 140.

Winding Unit 60

The winding unit 60 is configured so as to have guide rollers 66, 68 and 70, a dancer section 72 and a winding bobbin 80. In the winding unit 60, the metal tube 10 is provided in a tensioned state across the guide roller 66, a dancer roller 74, the guide roller 66, the guide roller 68, the guide roller 70 and the winding bobbin 80, in this order.

The guide rollers 66, 68 and 70 are rotatably mounted in the housing 12 of the drawing machine 100. The metal tube 10 is wound around each of the guide rollers 66, 68 and 70 a predetermined number of times so as to allow the metal tube 10 to be delivered in a non-slip manner. The guide rollers 66, 68 and 70 rotate due to tension applied to the metal tube 10 by the rotation of the winding bobbin 80, so that the drawn metal tube 10 in the drawing unit 40-*n* is sequentially delivered along the passage in a non-slip manner.

The dancer section 72 is configured so as to include the dancer roller 74, a dancer arm 76 and a torque motor 78, and applies a desired tension to the drawn metal tube 10 in the drawing unit 40-*n*.

The dancer roller 74 is rotatably supported at one end of the rod-shaped dancer arm 76. The metal tube 10 is provided in a tensioned state across the guide roller 66, the dancer roller 74, the guide roller 66, the guide roller 68 and the guide roller 70, in this order, and a predetermined tension is applied to the metal tube 10 by the dancer roller 74 in a downward direction in FIG. 1.

The dancer arm 76 is arranged approximately horizontally in FIG. 1, i.e., in a direction approximately perpendicular to the direction in which tension is applied to the metal tube 10 by the dancer roller 74. This horizontal arrangement is regarded as a reference position for the dancer arm 76. The other end of the dancer arm 76 is supported so as to be fixed to a drive shaft of the torque motor 78, and the drive shaft of the torque motor 78 acts as the pivot point of the dancer arm 76.

A potentiometer 178 (FIG. 2) is provided at the drive shaft of the torque motor 78 and it detects a pivot angle of the dancer arm 76. The potentiometer 178 is connected to the winding unit controller 160 and provides the pivot angle detected by the potentiometer 178 to the winding unit controller 160.

The torque motor 78 applies a predetermined tension to the metal tube 10 through the dancer arm 76 and the dancer roller 74. That is, the torque motor 78 transmits its rotation torque to the metal tube 10 through the dancer arm 76 and the dancer roller 74, thereby applying tension to the metal tube 10. The torque motor 78 is connected to the winding unit controller 160 and generates a predetermined rotation torque based on the commands (torque commands) from the winding unit controller 160.

The winding bobbin 80 is rotatably mounted in the housing 12 of the drawing machine 100. The winding bobbin 80 is connected to a winding motor 180 and rotates when driven by the motor. With that rotation, the drawn metal tube 10 in the drawing unit 40-*n* is wound around the winding bobbin 80. In the present embodiment, the winding bobbin 80 is driven by the winding motor 180 at a controlled speed. That is, the winding unit controller 160 controls the drive of the winding motor 180 so that the winding bobbin 80 rotates at a predetermined speed. More specifically, the winding unit controller 160 controls the drive of the winding motor 180 based on the circumferential speed of the drive capstan 50-*n* and the pivot angle of the dancer arm 76.

As described above, in the winding unit 60 according to the present embodiment, while the dancer section 72 applies a predetermined tension to the metal tube 10 delivered from the drawing unit 40-*n*, the winding bobbin 80 winds up the metal tube 10 at a constant speed.

Drawing Operation of Drawing Machine 100

Next, the operation of the drawing machine 100 having the above-described configuration, in order to draw the pipe-shaped metal tube 10, will be described with reference to FIGS. 1 and 2.

Setting of Circumferential Speeds of Drive Capstans 48 and 50

In each stage of the drawing unit 40, the outer diameter of the metal tube 10 which has passed through the drawing die 42 is determined by the hole diameter of the drawing die 42. In other words, the outer diameter of the metal tube 10 that is wound in the winding unit 60 is controlled by the outer diameter of the metal tube 10 delivered from the unwinding unit 20 and the hole diameter of each drawing die 42.

On the other hand, in the present embodiment, the inner diameter of the metal tube 10 which has passed through the drawing die 42 of a particular drawing unit 40 is controlled by the ratio between the circumferential speed of the drive capstan 48 provided before the drawing die 42 and the circumferential speed of the drive capstan 50 provided after the drawing die 42 in the particular drawing unit 40.

Since the volume of the metal tube 10 (including the inner space) passing through the drawing die 42 per unit time is constant, the following equation is established (wherein, in the drawing unit 40, the outer diameter and the inner diameter of the metal tube 10 before passing through the drawing die 42 are D1 and d1, respectively, the outer diameter [namely, the hole diameter of the drawing die 42] and the inner diameter of the metal tube 10 after passing through the drawing die 42 are D2 and d2, respectively, the circumferential speed of the drive capstan 48 is V1, and the circumferential speed of the drive capstan 50 is V2):

$$V1(\pi D1^2/4-\pi d1^2/4)=V2(\pi D2^2/4-\pi d2^2/4) \quad \text{(Equation 1).}$$

That is to say, the following equation is established:

$$V1(D1^2-d1^2)=V2(D2^2-d2^2) \quad \text{(Equation 2).}$$

In Equation 2, since D1, d1 and D2 are known constants, d2 (the inner diameter of the metal tube 10 after passing through the drawing die 42) can be controlled to a desired size by controlling the ratio between V1 (the circumferential speed of the drive capstan 48) and V2 (the circumferential speed of the drive capstan 50). The ratio between the rotation speed of the drive capstan 48 and the rotation speed of the drive capstan 50 may be controlled based on the circumference of the drive capstan 48 and the circumference of the drive capstan 50, instead of the ratio between the circumferential speed of the drive capstan 48 and the circumferential speed of the drive capstan 50. For example, if the circumference of the drive capstan 48 is equal to the circumference of the drive capstan 50, the ratio between the circumferential speed of the drive capstan 48 and the circumferential speed of the drive capstan 50 is equal to the ratio between their rotation speeds.

In the present embodiment, the circumferential speeds of the drive capstan 48 and the drive capstan 50 are set in each drawing unit 40 with reference to the circumferential speed of the drive capstan 50-*n* in the drawing unit 40-*n* of the last stage.

First, when the reduction rate of the outer diameter of the metal tube 10 (the ratio between the outer diameters of the metal tube 10 before and after each drawing die 42), the reduction rate of the inner diameter of the metal tube 10 (the ratio between the inner diameters of the metal tube 10 before and after each drawing die 42) in each drawing unit 40, and the circumferential speed V2 of the drive capstan 50-*n* in the drawing unit 40-*n* are set, the circumferential speed V1 of the drive capstan 48-*n* is determined based on Equation 2.

The circumferential speed V2 of the drive capstan 50-(*n*−1) in the drawing unit 40-(*n*−1) before the drive capstan 48-*n* is approximately the same as the circumferential speed V1 of the drive capstan 48-*n*. The circumferential speed V1 of the drive capstan 48-(*n*−1) can be determined based on Equation 2. In this way, the circumferential speed V1 of the drive capstan 48 and the circumferential speed V2 of the drive capstan 50 in each drawing unit 40 can be determined so as to obtain the metal tube 10 having desired outer and inner diameters.

Operation of Unwinding Unit 20

The unwinding unit 20 causes the metal tube 10 to be delivered out from the unwinding unit 20 at an approximately constant speed. Specifically, the unwinding unit controller 120 controls the speed of rotation of the unwinding motor 122 so that the speed at which the metal tube 10 is delivered from the unwinding unit 20 (hereinafter the speed at which the metal tube 10 is delivered at a particular point of the passage will be referred to as a "wire speed") is maintained at an approximately constant value according to the circumferential speed of the drive capstan 50-*n*. The wire speed of the metal tube 10 delivered from the unwinding unit 20 is approximately equal to the circumferential speed of the drive capstan 48-1 which is determined based on the circumferential speed of the drive capstan 50-*n*.

In the present embodiment, the unwinding unit controller 120 controls the speed of rotation of the unwinding motor 122 by using the wire speed of the metal tube 10 at the guide roller 44 as a feed-forward signal and the pivot angle of the dancer arm 36 as a feedback signal. More specifically, the circumferential speed of the drive capstan 48-1 is fed to the drawing unit controller 140 as the speed at which the metal tube 10 is delivered out from the unwinding unit 20, namely, the wire speed of the metal tube 10 passing through the drive capstan 48-1. The circumferential speed of the drive capstan 48-1 may be detected by, for example, an encoder provided at the drive capstan 48-1. Then, the unwinding unit controller 120 provides a speed signal indicative of the detected wire speed to the unwinding motor 122 as a feed-forward signal, thereby controlling the rotation of the unwinding motor 122.

Meanwhile, when the dancer arm 36 pivots and a predetermined tension is accordingly applied to the metal tube 10 delivered from the unwinding bobbin 22, a certain difference is created between the wire speed of the metal tube 10 delivered from the unwinding bobbin 22 and the wire speed of the metal tube 10 passing through the guide roller 44. The unwinding unit controller 120 generates a feedback signal based on the pivot angle detected by the potentiometer 138 and controls the rotation of the unwinding motor 122 so as to correct a gap in wire speed due to the above difference, thereby maintaining the wire speed of the metal tube 10 delivered out from the unwinding unit 20 at an approximately constant value.

More specifically, the unwinding unit controller 120 calculates a pivot angle deviation between the pivot angle of the dancer arm 36 detected by the potentiometer 138 and the pivot angle of the dancer arm 36 at the reference position. Then, the unwinding unit controller 120 determines the rotation speed of the unwinding motor 122 so as to approximate the calculated pivot angle deviation to zero, and provides a rotation speed command to the unwinding motor 122 based on the determined rotation speed. Using the pivot angle deviation as a feedback signal, the unwinding unit controller 120 controls the rotation speed of the unwinding motor 122 through P control, PI control, PID control, etc.

Operation of Drawing Units 40

Next, the operation of each drawing unit 40 drawing the metal tube 10 delivered from the unwinding unit 20 will be described.

The drawing unit controller 140 controls the rotation speed of each drive motor 150 connected to each drive capstan 48 and drive capstan 50 based on the circumferential speed which has been set based on Equation 2. For example, in a situation where: the drawing machine 100 is provided with five stages of drawing units 40; the metal tube 10 delivered from the unwinding unit 20 (i.e., the metal tube 10 serving as a base material) has an outer diameter of 1.5 mm, a thickness of 0.075 mm and an inner diameter of 1.35 mm; and such metal tube 10 is wound such that the metal tube 10 to be wound by the winding unit 60 has a target outer diameter of 1.0 mm and a target inner diameter of 0.9 mm, with the ratio between the outer diameter and the inner diameter of the metal tube 10 being constantly maintained, the hole diameter of the drawing die 42, as well as the circumferential speeds of the drive capstans 48 and 50, in each drawing unit 40, will be set as shown in the table below.

TABLE 1

| Wire drawing unit | Wire drawing die diameter (mm) | Metal tube outer diameter (mm) | Metal tube inner diameter (mm) | Thickness (mm) | Circumferential speed of drive capstan 48 (mm/min.) | Circumferential speed of drive capstan 50 (mm/min.) | Ratio of circumferential speed of drive capstan 48 to circumferential speed of drive capstan 50 |
|---|---|---|---|---|---|---|---|
| 40-1 | 1.40 | 1.40 | 1.26 | 0.07 | 44.44 | 51.02 | 0.8711 |
| 40-2 | 1.30 | 1.30 | 1.17 | 0.65 | 51.02 | 59.17 | 0.8622 |

TABLE 1-continued

| Wire drawing unit | Wire drawing die diameter (mm) | Metal tube outer diameter (mm) | Metal tube inner diameter (mm) | Thickness (mm) | Circumferential speed of drive capstan 48 (mm/min.) | Circumferential speed of drive capstan 50 (mm/min.) | Ratio of circumferential speed of drive capstan 48 to circumferential speed of drive capstan 50 |
|---|---|---|---|---|---|---|---|
| 40-3 | 1.20 | 1.20 | 1.08 | 0.60 | 59.17 | 69.44 | 0.8521 |
| 40-4 | 1.10 | 1.10 | 0.99 | 0.55 | 69.44 | 82.64 | 0.8403 |
| 40-5 | 1.00 | 1.00 | 0.90 | 0.50 | 82.64 | 100.00 | 0.8264 |

In a situation where the metal tube 10 delivered from the unwinding unit 20 (i.e., the base material) has an outer diameter of 1.5 mm, a thickness of 0.075 mm and an inner diameter of 1.35 mm, and the metal tube 10 is drawn such that the metal tube 10 to be wound by the winding unit 60 has a target outer diameter of 1.0 mm and a target inner diameter of 0.85 mm while having a constant thickness of 0.075 mm, the hole diameter of the drawing die 42, as well as the circumferential speeds of the drive capstans 48 and 50, in each drawing unit 40, will be set as shown in the table below.

TABLE 2

| Wire drawing unit | Wire drawing die diameter (mm) | Metal tube outer diameter (mm) | Metal tube inner diameter (mm) | Thickness (mm) | Circumferential speed of drive capstan 48 (mm/min.) | Circumferential speed of drive capstan 50 (mm/min.) | Ratio of circumferential speed of drive capstan 48 to circumferential speed of drive capstan 50 |
|---|---|---|---|---|---|---|---|
| 40-1 | 1.40 | 1.40 | 1.25 | 0.075 | 64.91 | 69.81 | 0.9298 |
| 40-2 | 1.30 | 1.30 | 1.15 | 0.075 | 69.81 | 75.51 | 0.9245 |
| 40-3 | 1.20 | 1.20 | 1.05 | 0.075 | 75.51 | 82.22 | 0.9184 |
| 40-4 | 1.10 | 1.10 | 0.95 | 0.075 | 82.22 | 90.24 | 0.9111 |
| 40-5 | 1.00 | 1.00 | 0.85 | 0.075 | 90.24 | 100.00 | 0.9024 |

The drawing unit controller 140 further controls, based on the pivot angle of each dancer arm 56 detected by the potentiometer 158, the rotation speed of the drive capstan 50 provided in the drawing unit 40 located before each dancer arm 56.

Specifically, when a difference in the circumferential speed occurs between the drive capstan 50 and the drive capstan 48 located before and after a dancer section 52, the dancer arm 56 of such dancer section 52 pivots based on such difference. For example, if the circumferential speed of the drive capstan 50 is slower than the circumferential speed of the drive capstan 48, the dancer arm 56 pivots upward in FIG. 1. The potentiometer 158 (an example of a speed difference detecting section) detects the difference (pivot angle), and the drawing unit controller 140 then controls the rotation speed of the drive capstan 50 located before the dancer section 52 based on the detected difference.

With such configuration, since the circumferential speeds of the drive capstans 48 and 50 located before and after the dancer section 52 can be maintained so as to be substantially constant, the inner diameter of the metal tube 10 passing through each drawing die 42 can be controlled to a desired size.

The dancer section 52 (an example of a tension applying section) may control the tension of the metal tube 10 between the two adjacent drawing units 40. With such configuration, the tension applied to the metal tube 10 by the previous drawing unit 40 can be reset and the metal tube 10 can be delivered to the next drawing unit 40 with a predetermined tension applied thereto.

Operation of Winding Unit 60

The winding unit 60 winds up the metal tube 10 such that the metal tube 10 which has been delivered from the unwinding unit 20 and then drawn in each drawing unit 40 has an approximately constant wire speed. That is, the winding unit controller 160 controls the speed of rotation of the winding motor 180 so that the wire speed of the metal tube 10 supplied to the winding unit 60 is maintained at an approximately constant value.

In the present embodiment, the winding unit controller 160 controls the speed of rotation of the winding motor 180, for example, by using the speed of rotation of (i.e., the wire speed of the metal tube 10 at) the drive capstan 50-*n* which is located before the winding unit 60 as a feed-forward signal, and the pivot angle of the dancer arm 76 as a feedback signal. More specifically, the wire speed of the metal tube 10 passing through the drive capstan 50-*n* is detected by an encoder provided at the drive capstan 50-*n* and is fed to the drawing unit controller 140. Then, the winding unit controller 160 generates a speed signal indicative of the detected wire speed as a feed-forward signal and supplies it to the winding motor 180 to control the rotation of the winding motor 180.

Further, the winding unit controller 160 generates a feedback signal based on the pivot angle detected by the potentiometer 178 and controls the rotation of the winding motor 180.

More specifically, the winding unit controller 160 calculates a pivot angle deviation between the pivot angle of the dancer arm 76 detected by the potentiometer 178 and the pivot angle of the dancer arm 76 at the reference position. Then, the winding unit controller 160 determines the rotation speed of the winding motor 180 so as to approximate the pivot angle deviation to zero, and provides a rotation speed command to the winding motor 180 based on the determined rotation speed. Using the pivot angle deviation as a feedback signal, the winding unit controller 160 controls the rotation speed of the winding motor 180 through P control, PI control, PID control, etc.

By way of the above operation, the winding unit 60 can maintain the wire speed of the metal tube 10 delivered from the drawing unit 40-*n* (in other words, the wire speed of the metal tube 10 at the drive capstan 50-*n*) at an approximately constant value regardless of the amount of metal tube 10 already wound around the winding bobbin 80, and at the same time, wind up the metal tube 10 around the winding bobbin 80 so that there is no gap between the above wire speed and the wire speed of the metal tube 10 passing through the guide rollers 68 and 70.

The drawing machine 100 according to the present embodiment is capable of producing a metal tube 10 having a desired outer diameter and inner diameter due to the above-mentioned configurations and operations.

The examples and applications described above through the embodiment of the invention can be combined as appropriate depending on the intended purpose of use, or used by making various modifications or improvements, and the invention is not limited to the above-described embodiment. It will be apparent from the description of the attached claims that such combinations or embodiments in which such modifications or improvements are made can also fall within the technical scope of the invention.

REFERENCE SIGNS LIST

10 . . . metal tube; 20 . . . unwinding unit; 22 . . . unwinding bobbin; 24, 26, 28 . . . guide roller; 32 . . . dancer section; 34 . . . dancer roller; 36 . . . dancer arm; 38 . . . torque motor; 40 . . . drawing unit; 42 . . . drawing die; 44, 46 . . . guide roller; 50 . . . drive capstan; 60 . . . winding unit; 66, 68, 70 . . . guide roller; 72 . . . dancer section; 74 . . . dancer roller; 76 . . . dancer arm; 78 . . . torque motor; 80 . . . winding bobbin; 100 . . . drawing machine; 110 . . . system controller; 120 . . . unwinding unit controller; 122 . . . unwinding motor; 138 . . . potentiometer; 140 . . . drawing unit controller; 150 . . . drive motor; 160 . . . winding unit controller; 178 . . . potentiometer; 180 . . . winding motor; 200 . . . control unit.

What is claimed is:

1. A drawing machine for controlling a size of an outer diameter and a size of an inner diameter of a metal tube having a hollow structure, the drawing machine comprising:

a first drawing unit that includes: a first drawing die that reduces at least the outer diameter of the metal tube passing therethrough, thereby drawing the metal tube; a first upstream capstan that is provided before the first drawing die so as to deliver the metal tube to the first drawing die; and a first downstream capstan that is provided after the first drawing die so as to draw the metal tube from the first drawing die;

a second drawing unit that includes: a second drawing die that reduces at least the outer diameter of the metal tube delivered from the first drawing unit, thereby drawing the metal tube; a second upstream capstan that is provided before the second drawing die so as to deliver the metal tube delivered from the first drawing unit to the second drawing die; and a second downstream capstan that is provided after the second drawing die so as to draw the metal tube from the second drawing die;

a dancer that applies a predetermined tension to the metal tube between the first drawing unit and the second drawing unit, wherein the dancer is between the first drawing die and the second drawing die; and a drawing unit controller connected to the first drawing unit, the second drawing unit and the dancer, wherein the drawing unit controller controls the size of the inner diameter of the metal tube, wherein the drawing unit controller controls a first speed ratio between a circumferential speed of the first upstream capstan and a circumferential speed of the first downstream capstan, and wherein the drawing unit controller controls a second speed ratio between a circumferential speed of the second upstream capstan and a circumferential speed of the second downstream capstan.

2. The drawing machine according to claim 1, wherein the drawing unit controller controls the circumferential speed of the first upstream capstan and the circumferential speed of the first downstream capstan such that the first speed ratio becomes substantially constant, and wherein the drawing unit controller controls the circumferential speed of the second upstream capstan and the circumferential speed of the second downstream capstan such that the second speed ratio becomes substantially constant.

3. The drawing machine according to claim 2, wherein the drawing unit controller controls the circumferential speed of the first downstream capstan based on the circumferential speed of the second upstream capstan.

4. The drawing machine according to claim 3, wherein the drawing unit controller controls the circumferential speed of the first downstream capstan based on a speed difference between the circumferential speed of the first downstream capstan and the circumferential speed of the second upstream capstan.

5. The drawing machine according to claim 3, wherein the drawing unit controller controls the circumferential speed of the first downstream capstan based on the predetermined tension applied to the metal tube by the dancer between the first drawing unit and the second drawing unit.

6. The drawing machine according to claim 1, wherein the dancer is between the first downstream capstan and the second upstream capstan.

7. The drawing machine according to claim 1, wherein the first downstream capstan and the second upstream capstan are between the first drawing die and the second drawing die.

8. The drawing machine according to claim 1, wherein the drawing unit controller controls the size of the inner diameter of the metal tube via the first speed ratio.

9. The drawing machine according to claim 8, wherein the drawing unit controller controls the size of the inner diameter of the metal tube via the second speed ratio.

10. The drawing machine according to claim 1, wherein the circumferential speed of the first downstream capstan and the circumferential speed of the second upstream capstan are maintainable at the same circumferential speed by the drawing unit controller to control the size of the inner diameter of the metal tube.

11. The drawing machine according to claim 1, wherein the drawing unit controller controls a ratio between the size of the outer diameter of the metal tube and the size of the inner diameter of the metal tube.

12. The drawing machine according to claim 1, wherein the size of the inner diameter of the metal tube is controllable by the drawing unit controller, and wherein a ratio between the size of the outer diameter of the metal tube and the size of the inner diameter of the metal tube is controllable by the drawing unit controller controlling the circumferential speed of the first upstream capstan, the circumferential speed of the first downstream capstan, the circumferential speed of the second upstream capstan, and the circumferential speed of the second downstream capstan.

13. The drawing machine according to claim 1, wherein the metal tube is maintainable at a constant thickness as the size of the inner diameter is decreased.

14. The drawing machine according to claim 1, wherein the dancer is pivotable based on a difference between the circumferential speed of the first downstream capstan and the circumferential speed of the second upstream capstan.

15. A drawing method controlling a size of an outer diameter and a size of an inner diameter of a metal tube having a hollow structure, the method comprising the steps of:

delivering, using a first upstream capstan, the metal tube to a first drawing die;

drawing, using a first downstream capstan, the metal tube from the first drawing die;

applying a predetermined tension to the metal tube delivered from the first downstream capstan;

delivering, using a second upstream capstan, the metal tube which has been delivered from the first downstream capstan and to which the predetermined tension has been applied, to a second drawing die;

drawing, using a second downstream capstan, the metal tube from the second drawing die;

controlling a first speed ratio between a circumferential speed of the first upstream capstan and a circumferential speed of the first downstream capstan, controlling a second speed ratio between a circumferential speed of the second upstream capstan and a circumferential speed of the second downstream capstan, and controlling the size of the inner diameter of the metal tube via the first speed ratio.

16. The drawing method according to claim 15, further comprising controlling the size of the inner diameter of the metal tube via the second speed ratio.

17. The drawing method according to claim 15, further comprising controlling the size of the inner diameter of the metal tube by maintaining the circumferential speed of the first downstream capstan and the circumferential speed of the second upstream capstan at the same circumferential speed.

18. The drawing method according to claim 15, further comprising maintaining the metal tube at a constant thickness as the size of the inner diameter is decreased.

19. The drawing method according to claim 15, further comprising applying the predetermined tension to the metal tube between the first drawing die and the second drawing die.

20. A drawing machine for controlling a size of an outer diameter and a size of an inner diameter of a metal tube having a hollow structure, the drawing machine comprising:

a first drawing unit that includes: a first drawing die that reduces at least the outer diameter of the metal tube passing therethrough, thereby drawing the metal tube; a first upstream capstan that is provided before the first drawing die so as to deliver the metal tube to the first drawing die; and a first downstream capstan that is provided after the first drawing die so as to draw the metal tube from the first drawing die;

a second drawing unit that includes: a second drawing die that reduces at least the outer diameter of the metal tube delivered from the first drawing unit, thereby drawing the metal tube; a second upstream capstan that is provided before the second drawing die so as to deliver the metal tube delivered from the first drawing unit to the second drawing die; and a second downstream capstan that is provided after the second drawing die so as to draw the metal tube from the second drawing die;

a dancer that applies a predetermined tension to the metal tube; and a drawing unit controller connected to the first drawing unit, the second drawing unit and the dancer, wherein the drawing unit controller controls a first speed ratio between a circumferential speed of the first upstream capstan and a circumferential speed of the first downstream capstan, wherein the drawing unit controller controls a second speed ratio between a circumferential speed of the second upstream capstan and a circumferential speed of the second downstream capstan, and wherein the dancer is pivotable based on a difference between the circumferential speed of the first downstream capstan and the circumferential speed of the second upstream capstan.

* * * * *